US012098536B2

(12) United States Patent
Wang et al.

(10) Patent No.: US 12,098,536 B2
(45) Date of Patent: Sep. 24, 2024

(54) MODULAR BUILDING STRUCTURE

(71) Applicant: A&C Future, Inc, Newport Beach, CA (US)

(72) Inventors: Jiuqi Wang, Tustin, CA (US); Zhuangboyu Zhou, Santa Ana, CA (US); Sichen Li, Irvine, CA (US); Keguan Zou, Irvine, CA (US); Jiayang Qin, Newport Beach, CA (US); Han Qin, Newport Beach, CA (US)

(73) Assignee: A&C Future Inc

( * ) Notice: Subject to any disclaimer, the term of this patent is extended or adjusted under 35 U.S.C. 154(b) by 265 days.

(21) Appl. No.: 17/861,132

(22) Filed: Jul. 8, 2022

(65) Prior Publication Data

US 2024/0011276 A1 Jan. 11, 2024

(51) Int. Cl.

| | |
|---|---|
| ***E04B 1/02*** | (2006.01) |
| ***E04B 1/18*** | (2006.01) |
| ***E04B 1/61*** | (2006.01) |
| ***E04C 2/52*** | (2006.01) |

(52) U.S. Cl.

CPC ..... *E04B 1/02* (2013.01); *E04B 1/18* (2013.01); *E04B 1/61* (2013.01); *E04C 2/521* (2013.01)

(58) Field of Classification Search

None

See application file for complete search history.

(56) References Cited

U.S. PATENT DOCUMENTS

| | | | | |
|---|---|---|---|---|
| 7,779,600 | B1 * | 8/2010 | Saebi | E04B 1/18 52/309.1 |
| 7,866,117 | B1 * | 1/2011 | Saebi | E04B 1/161 52/309.3 |
| 11,781,315 | B1 * | 10/2023 | Zhou | E04B 1/02 52/238.1 |
| 2010/0132284 | A1 * | 6/2010 | Takeshima | E04B 5/04 52/236.1 |
| 2018/0340326 | A1 * | 11/2018 | Pirrung | E04B 1/61 |
| 2020/0256051 | A1 * | 8/2020 | Becerril Hernández | E04B 1/18 |
| 2024/0011276 | A1 * | 1/2024 | Wang | E04C 2/521 |

* cited by examiner

*Primary Examiner* — Joshua K Ihezie

(74) *Attorney, Agent, or Firm* — Elizabeth Yang

(57) ABSTRACT

The present invention provides a modular building structure, comprising: a plurality of floor slab frames, a plurality of first wall panels, a plurality of second wall panels, a plurality of floor module boards, and a plurality of ceiling module boards. The two adjacent floor slab frames are connected through a plurality of clips, so as to fix the floor slab frames together. Through those structure, the workers can quickly build multiple floors with strength not much different from normal floors, while all the modular components ensure that they can be prefabricated in advance in the factory, which can also significantly improve the transportation efficiency.

13 Claims, 14 Drawing Sheets

MODULAR BUILDING STRUCTURE

FIELD OF THE INVENTION

The present invention relates generally to a modular building structure, and more particularly, the present invention effectively improves the traditional building process by optimizing the way of installation of connections between floor slabs, ceiling, walls, and beams during the construction of housing to shorten the total building time.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

In the housing industry, the process of building a home is tedious and time-consuming. The process of making the walls has been a big part of the whole process. Whether it is pouring with reinforced cement, nailing wooden studs followed by plasterboard, or building with bricks it can take a lot of time. This greatly increases the expenses of building a house. If the wall building time can be reduced, then the building expenses will be greatly reduced, so that more people can own their own houses.

In order to reduce the time spent in the construction process, it is urgent to solve the problem of floor assembly. However, traditional building floors still use cast-in-place concrete structures, which require a lot of formwork materials, laying steel bars on site, and then pouring concrete, which is time-consuming and labor-intensive, and the construction cost is high. There are also some modular floor slabs in the existing technology, and the floor slab assembly construction is realized by splicing, but this kind of floor slab only solves the connection and assembly between the unit slabs, and the structural strength is not enough for the large-span integral floor slab.

Therefore, how to quickly and efficiently reduce the time for building a floor is the main problem that the applicant wants to solve.

SUMMARY

In order to solve the problem above, the present invention redefines the way of building walls by improving the traditional method of building walls. Based on the linkage principle, an internal frame that can be folded was designed. The frame can be folded and unfolded in a fairly short period, and after unfolding, there is a corresponding retraction device to fix it. After the frame is unfolded, the wall is assembled by applying a special wall skin (containing a housing material for sound and heat insulation and fire protection). This process not only optimizes the traditional wall building process but also completes other processes such as exterior decoration at the same time, greatly reducing the building time. The factory's internal frame and wall skin are prefabricated, saving the construction site steps. The frame and siding are available in two different configurations to meet the needs of the walls in most cases.

It is therefore an object of the present invention to provide floor frames, floor skins, ceiling skins, and wall panels for building structure that can be mass-produced in a factory by a manufacturer.

It is another object of the present invention to provide a new way of processing building floors.

It is yet another object of the present invention to provide an improved traditional way of building houses, thereby increasing the efficiency of building houses.

It is a further object of the present invention to provide a design that improves the way of installation of connections between floor slabs, walls, and beams during the construction of housing.

To achieve the objects above, the present invention provides a modular building structure, comprising:

- a plurality of floor slab frames, at least one side of the floor slab frames is connected and fixed with beams, and a plurality of floor connection holes and a plurality of wall panel holes are arranged on the top surface of the floor slab frames, wherein the wall panel holes are respectively provided at both ends of the top surface of the floor slab frames, and the bottom surfaces of the floor slab frames are provided with a plurality of ceiling connection holes; both sides of the floor slab frames are provided with a plurality of side holes, and edges of the side holes are provided with a plurality of joint holes for inserting into the joint holes of the two adjacent floor slab frames through a plurality of clips, so as to connect and fix the floor slab frames together;
- a plurality of first wall panels, the bottom of which is provided with a plurality of first protrusions for being inserted into the wall panel holes and fixed on the floor slab frames;
- a plurality of second wall panels, which are provided with a plurality of second protrusions on a side surface adjacent to bottom for being inserted into the side holes and fixed on the floor slab frames;
- a plurality of floor module boards, one side of which is provided with a plurality of floor projections for being inserted into the floor connection holes and then fixed on the floor slab frames; and
- a plurality of ceiling module boards, one side of which is provided with a plurality of ceiling projections for being inserted into the ceiling connection holes and then fixed on the floor slab frames.

In another aspect, wherein the clips are U-shaped, and both ends are provided with a barbed structure to improve the connectivity with the joint holes.

In another aspect, wherein two sides of the first wall panels and the second wall panels are respectively provided with a connecting groove for a fixing member to connect the first wall panels adjacent to each other and the second wall panels adjacent to each other or connect the first wall panels and the second wall panels with adjacent columns.

In another aspect, wherein the floor module boards and the ceiling module boards are connected to the floor connection holes and the ceiling connection holes by means of a press-fit.

In another aspect, wherein after the first wall panels are connected with the floor slab frames, the first projections are fixed in the wall panel holes through a plurality of screws, so as to fix the first wall panels to the floor slab frames.

In another aspect, wherein the floor slab frames are prefabricated with electrical wiring and plumbing.

In another aspect, wherein the first wall panels are provided with a plurality of grooves for placing wire modules and/or water pipe modules, and when the first wall panels are connected to the floor slab frames, the wire modules are communicated with the electrical wiring in the floor slab frames, and the water pipe modules are communicated with the plumbing in the floor slab frames.

Furthermore, the present invention further comprising at least one filling block for filling the grooves when the wire modules or the water pipe modules are not placed in the grooves.

In another aspect, wherein one end of the wire module is provided with at least one socket and the other end is provided with a plurality of wire contacts, and the socket and the wire contacts are electrically connected through wires in the wire module.

In another aspect, wherein the second protrusions are provided with a plurality of wire connectors, and surfaces of the second wall panels are provided with a plurality of electrical components, and the electrical components are electrically connected to the wire connectors.

In another aspect, wherein the floor projections, ceiling projections, floor connection holes, and ceiling connection holes are octagon.

In another aspect, wherein the thickness of the ceiling module board is less than the thickness of the floor module board.

In another aspect, wherein a hole is provided on a surface of at least one of the floor module boards, and a connecting pipe is provided in one of the floor projections corresponding to the hole.

The present invention consists of walls with prefabricated utilities, and connections, floor slabs with prefabricated utilities, and floor skins and ceiling skins used above and below the floor slabs. The design optimizes the way of installation of connections between floor slabs, walls, and beams during the construction of housing. At the same time, the floor slab has the function of prefabricated utility lines, and the house can be completed by simply connecting it with the prefabricated walls with utilities. Once the floor and walls are built and the utilities are connected, the floor and ceiling are simply snapped into the reserved floor space.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 1:
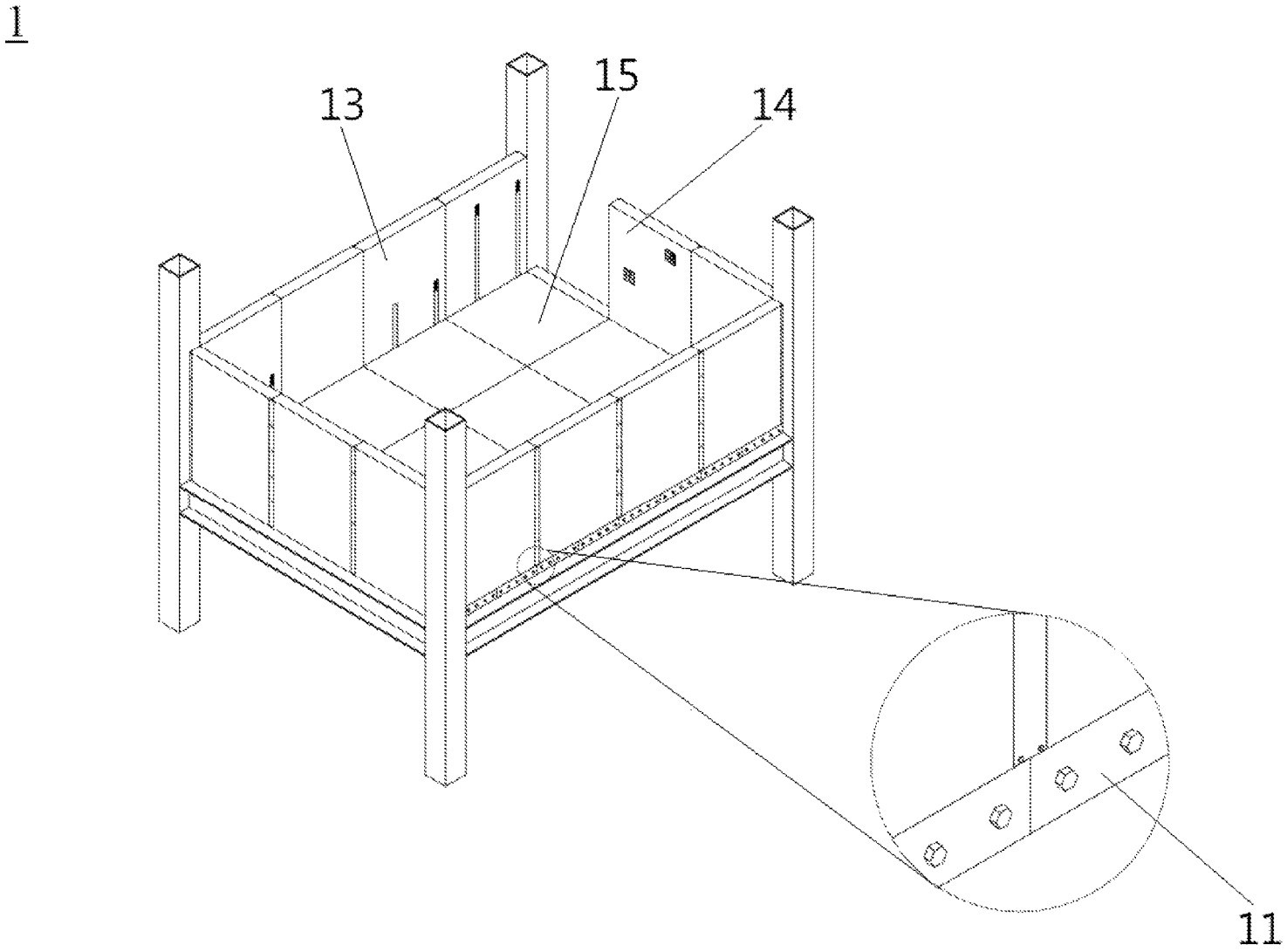
FIG. 1 illustrates the schematic view of an assembled building structure.

Please refer to FIG. 1, it illustrates the schematic view of an assembled building structure. In the present invention, the purpose is to fill the gap between the floor and the beam so that there is not a dented area after the house is installed. The wall and beam, slab and beam are linked by several bolts in FIG. 1.

Please refer to FIGS. 2-8, they show the schematic view and explosion view of the components that is needed to build the present invention. The modular building structure 1, comprising: a plurality of floor slab frames 11, a plurality of first wall panels 13, a plurality of second wall panels 14, a plurality of floor module boards 15, and a plurality of ceiling module boards 16. At least one side of the floor slab frames 11 is connected and fixed with beams, and a plurality of floor connection holes 111 and a plurality of wall panel holes 112 are arranged on the top surface of the floor slab frames 11, wherein the wall panel holes 112 are respectively provided at both ends of the top surface of the floor slab frames 11, and the bottom surfaces of the floor slab frames 11 are provided with a plurality of ceiling connection holes 113; both sides of the floor slab frames 11 are provided with a plurality of side holes 114, and edges of the side holes 114 are provided with a plurality of joint holes 115 for inserting into the joint holes 115 of the two adjacent floor slab frames 11 through a plurality of clips 12, so as to connect and fix the floor slab frames 11 together. The bottom of each first wall panel 13 is provided with a plurality of first protrusions 131 for being inserted into the wall panel holes 112 and fixed on the floor slab frames 11. The second wall panels 14 are provided with a plurality of second protrusions 141 on a side surface adjacent to bottom for being inserted into the side holes 114 and fixed on the floor slab frames 11. One side of each floor module board 15 is provided with a plurality of floor projections 151 for being inserted into the floor connection holes 111 and then fixed on the floor slab frames 11. One side of each ceiling module board 16 is provided with a plurality of ceiling projections 161 for being inserted into the ceiling connection holes 113 and then fixed on the floor slab frames 11.

Figure 2:
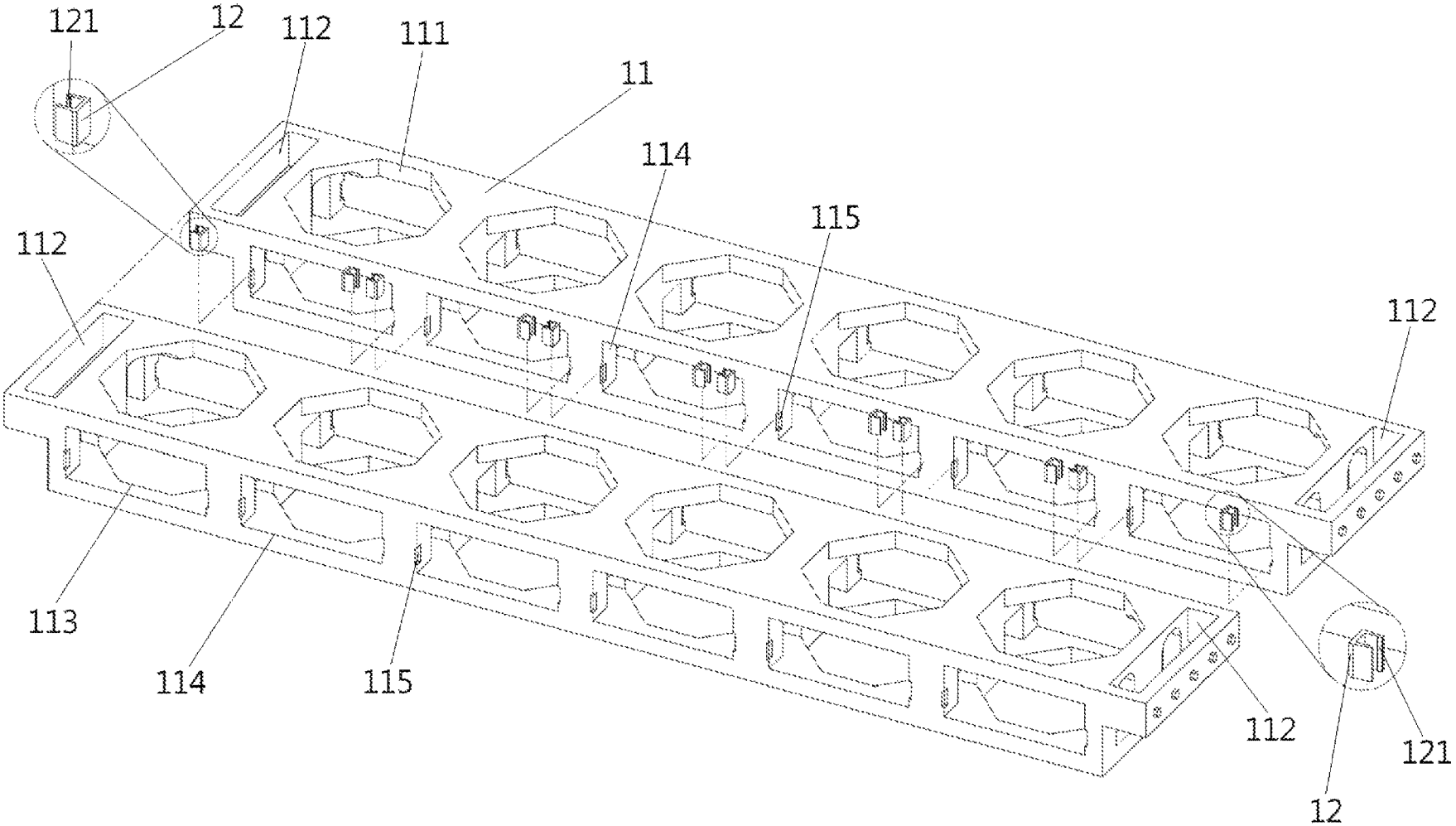
FIG. 2 illustrates the explosion view of connection between two floor slab frames.
Figure 3:
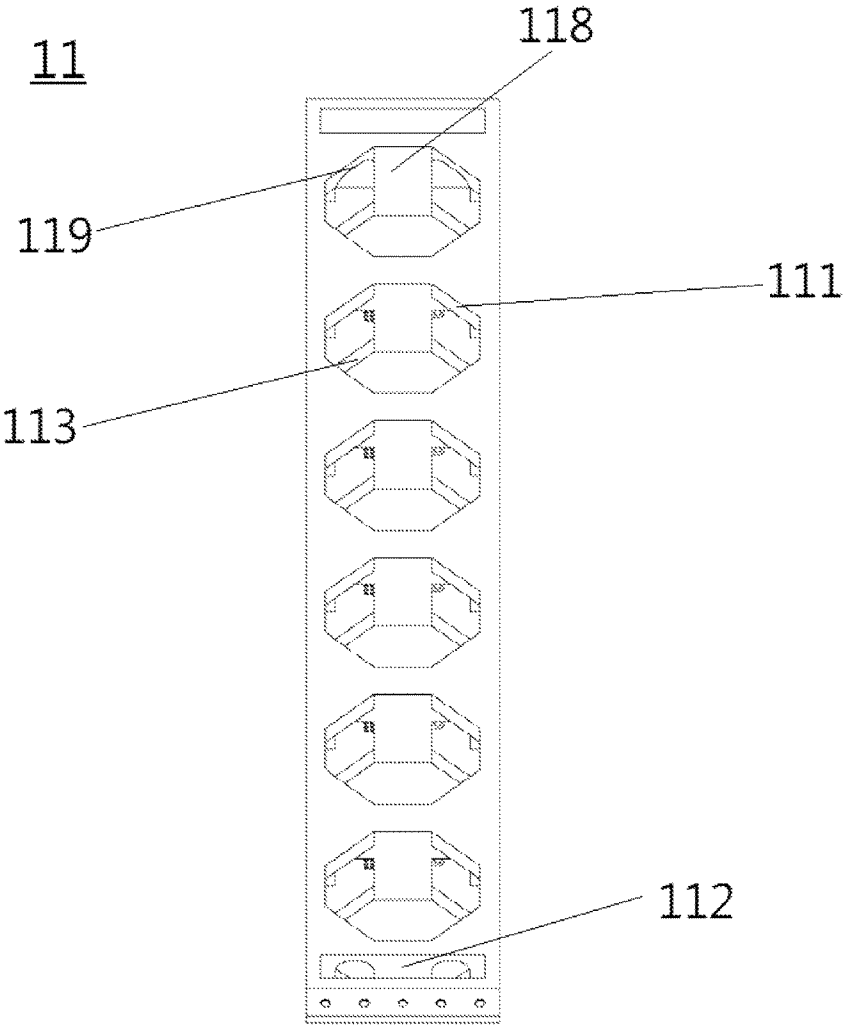
FIG. 3 shows another angle of schematic view of the floor slab frame.
Figure 4:
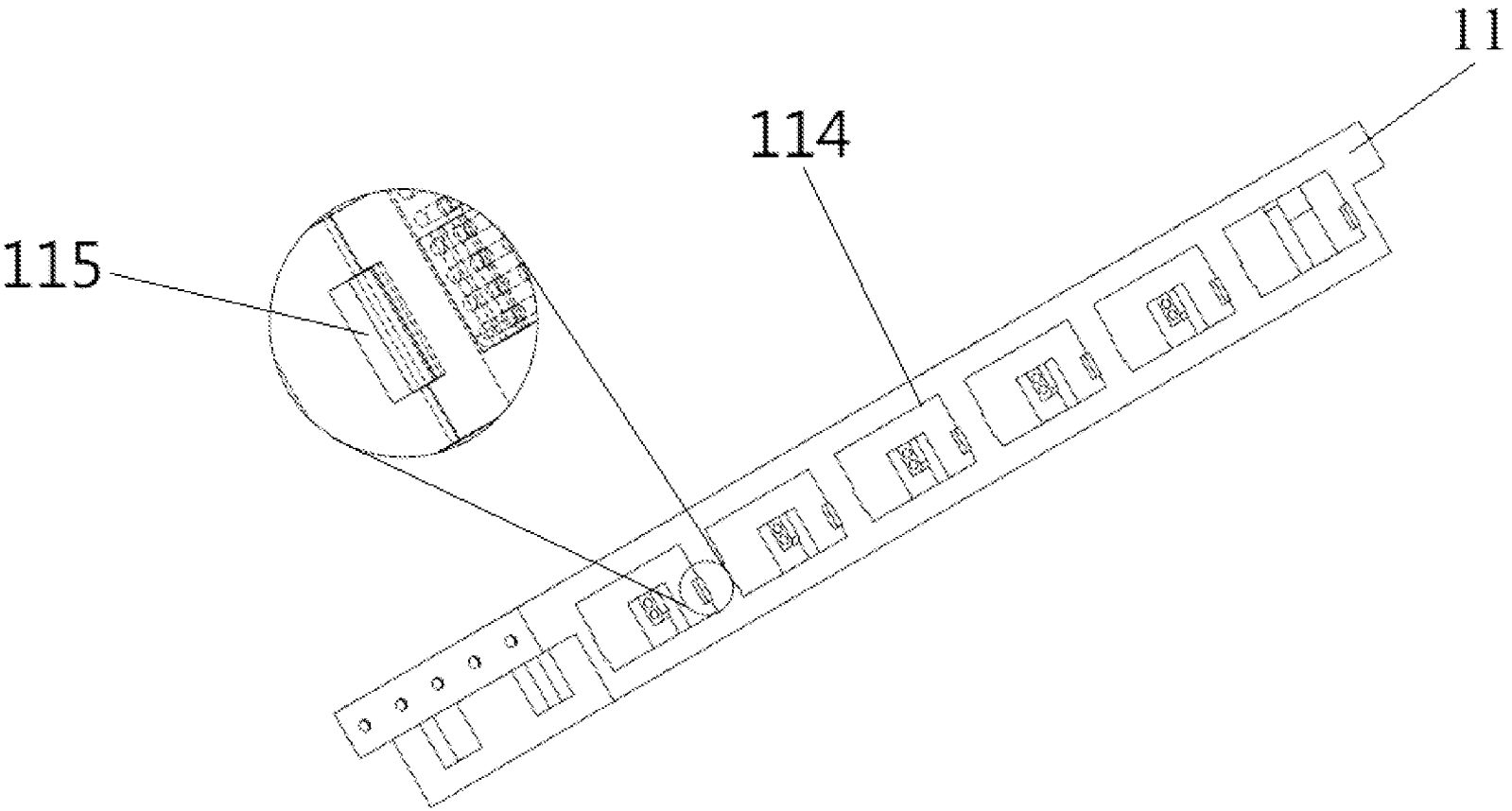
FIG. 4 illustrates the schematic view showing the depth of joint holes.

Through the above-mentioned modular structure, the present invention allows workers to quickly construct floor slabs, walls and ceilings of each floor. In FIGS. 2 and 4, the two floor slab frames 11 are mounted side by side and secured by the clips 12 connected to the joint holes 115. In particular, the clips 12 are U-shaped, and both ends are provided with a barbed structure 121 to improve the connectivity with the joint holes 115, so that the clips 12 can have a strong connection with the joint holes 115 to prevent the floor slab frames 11 falling apart. In FIG. 4, the joint holes 115 can be seen to have a depth to allow the clips 12 to insert. Since the clips 12 are mounted between the floor slab frames 11, the multiple clips 12 can spread the force out well, so that the floor slab frames 11 can stand great weight without broken. In FIG. 3, the ceiling connection holes 113 and the floor connection holes 111 are connected by connecting bars 118 to increase the structural rigidity.

Figure 5:
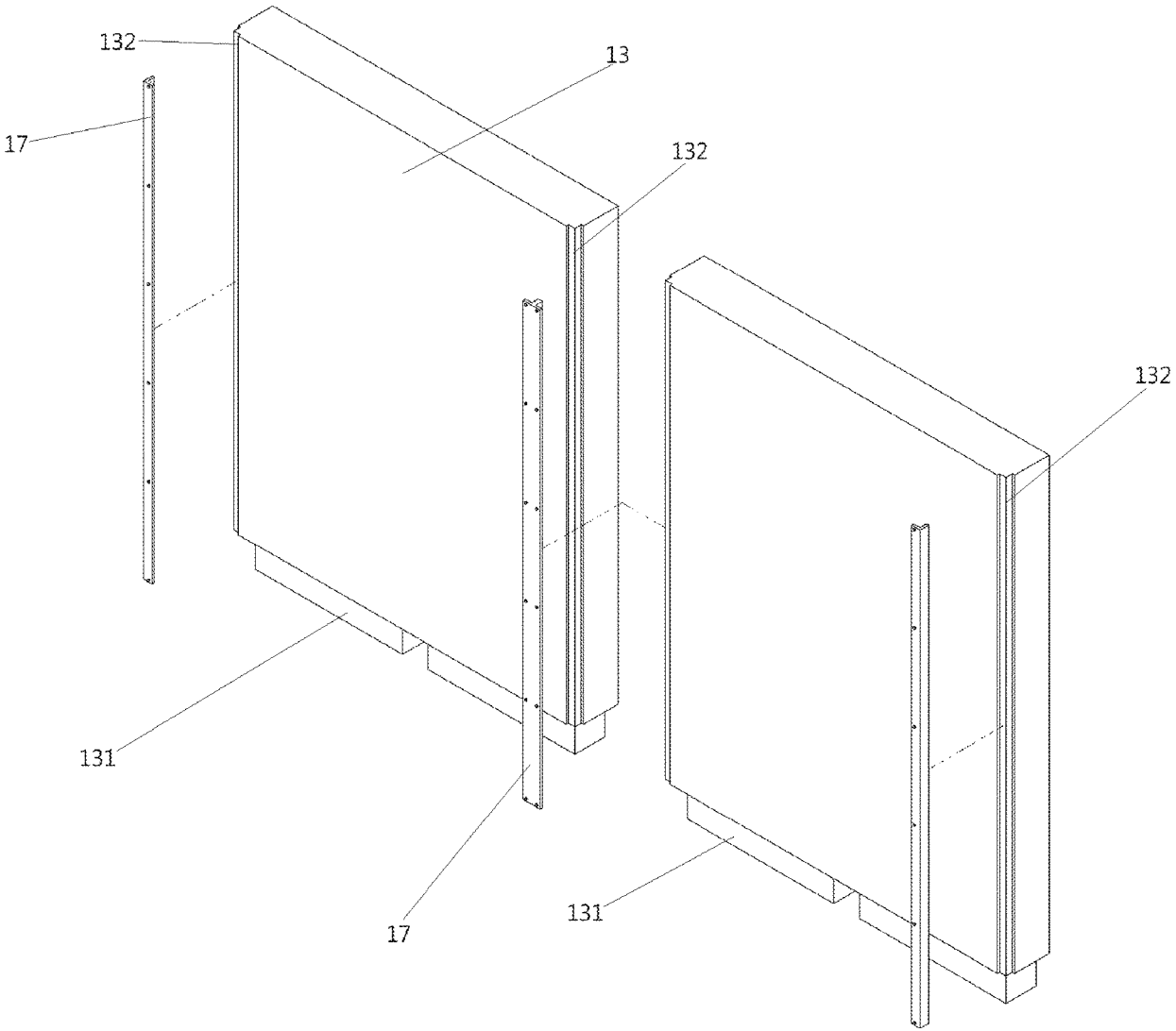
FIG. 5 illustrates the schematic view of first wall panels.
Figure 6:
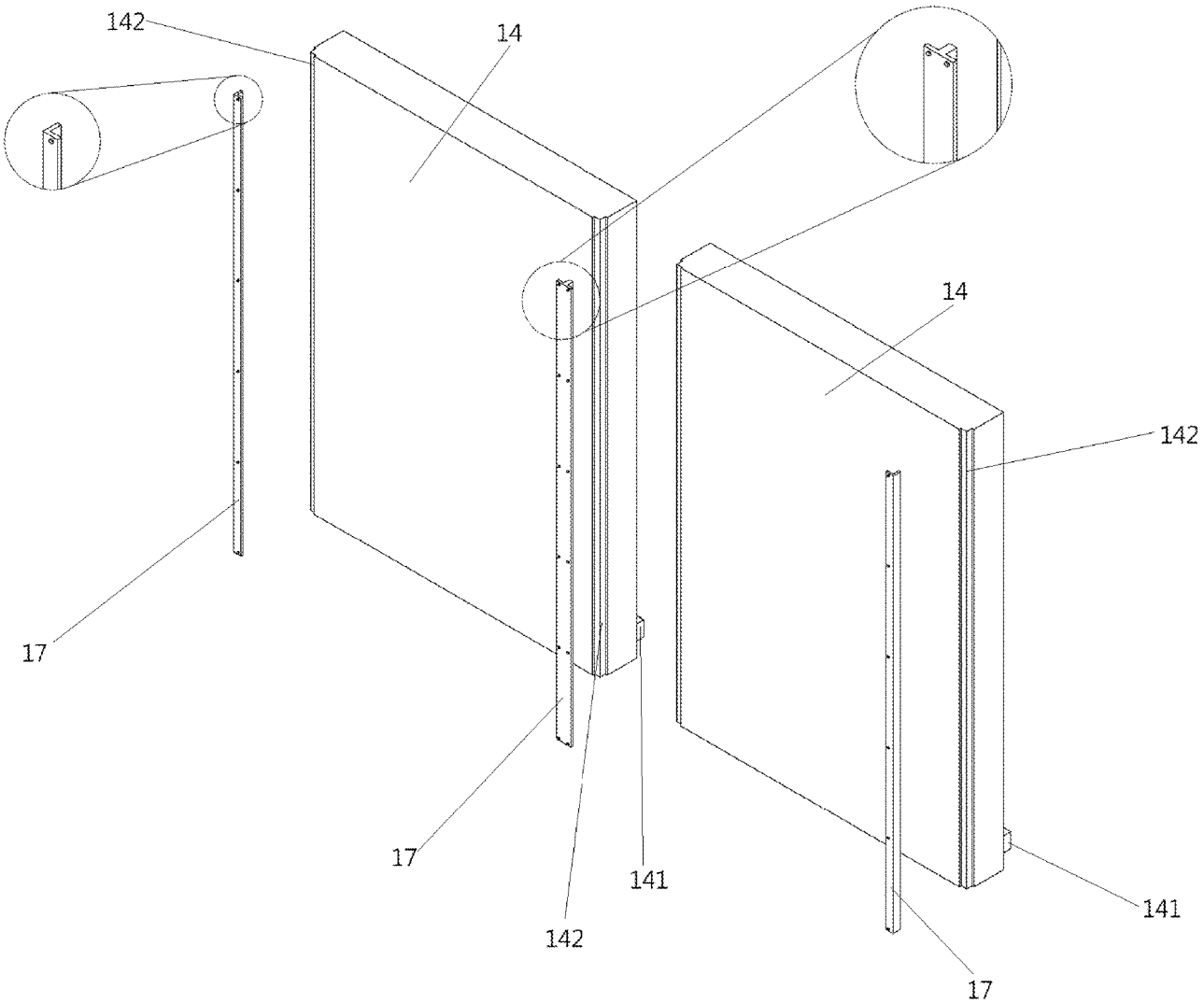
FIG. 6 illustrates the schematic view of second wall panels.

In FIGS. 5 and 6, they illustrate the schematic view of first wall panels and second wall panels. In particular, two sides of the first wall panels 13 and the second wall panels 14 are respectively provided with a connecting groove (132, 142) for a fixing member 17 to connect the first wall panels 13 adjacent to each other and the second wall panels 14 adjacent to each other or connect the first wall panels 13 and the second wall panels 14 with adjacent columns.

Figure 8:
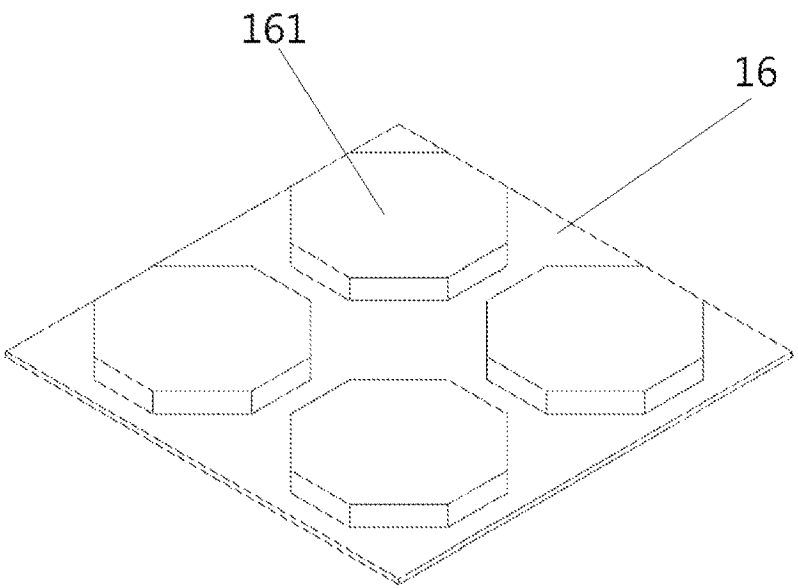
FIG. 8 illustrates the schematic view of ceiling module boards.
Figure 7:
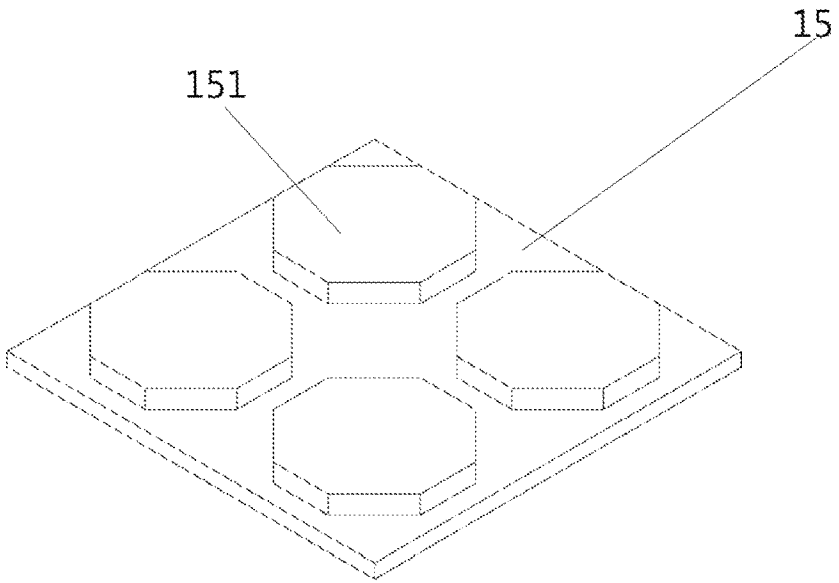
FIG. 7 illustrates the schematic view of floor module boards.

In FIGS. 7 and 8, they illustrate the schematic view of floor module boards and ceiling module boards. In particular, they are not just contain floor projections 151 and ceiling projections 161 respectively, the thickness of the ceiling module board 16 is also less than the thickness of the floor module board 15 to help the worker to identify between the two, and the floor projections 151, ceiling projections 161, floor connection holes 111, and ceiling connection holes 113 are octagon to increase the connectivity between the floor module board 15 and the floor slab frame 11 or the ceiling module board 16 and the floor slab frame 11.

Figure 9:
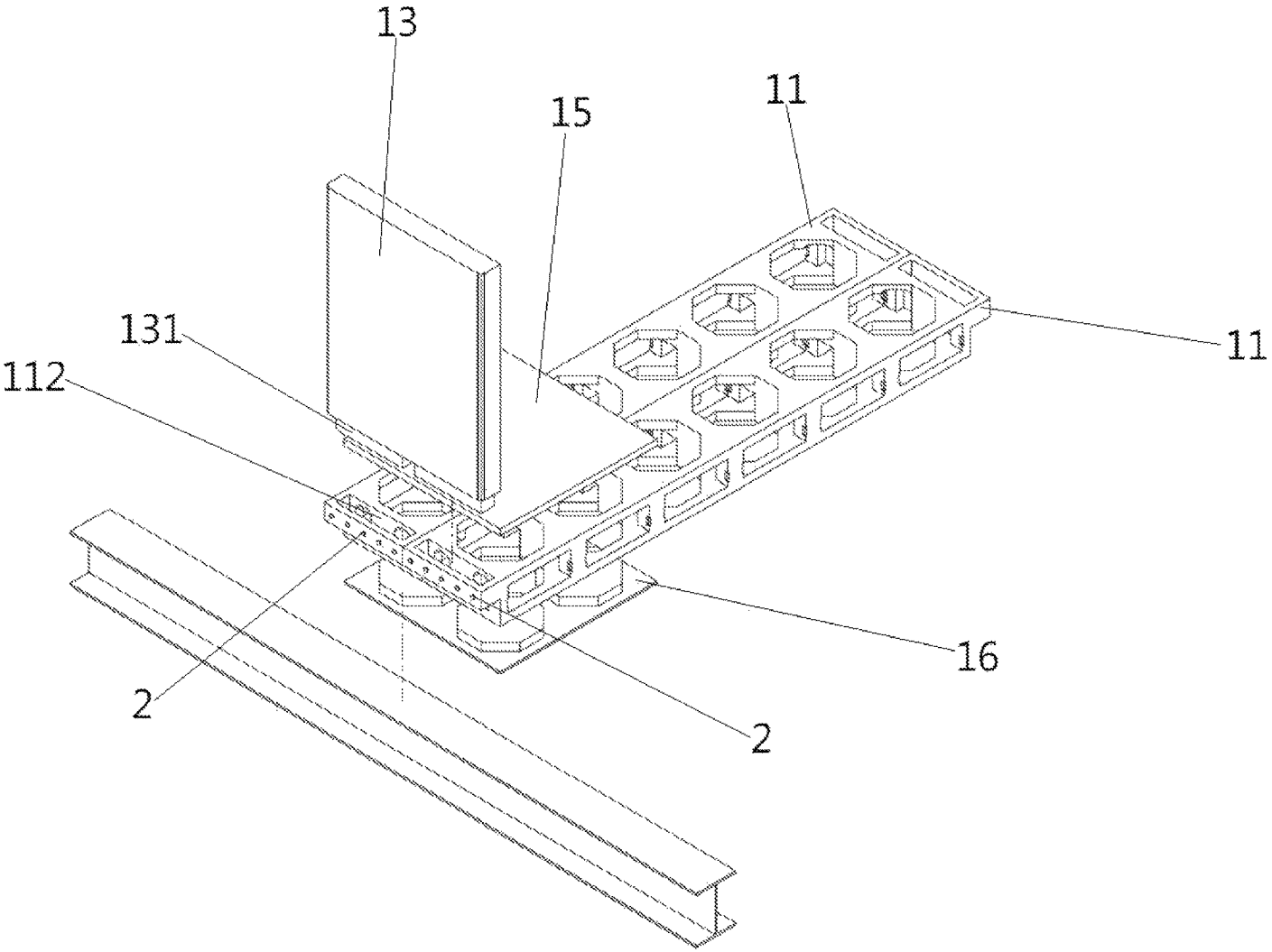
FIG. 9 illustrates the schematic view of the combination of floor slab frame and other components.
Figure 10:
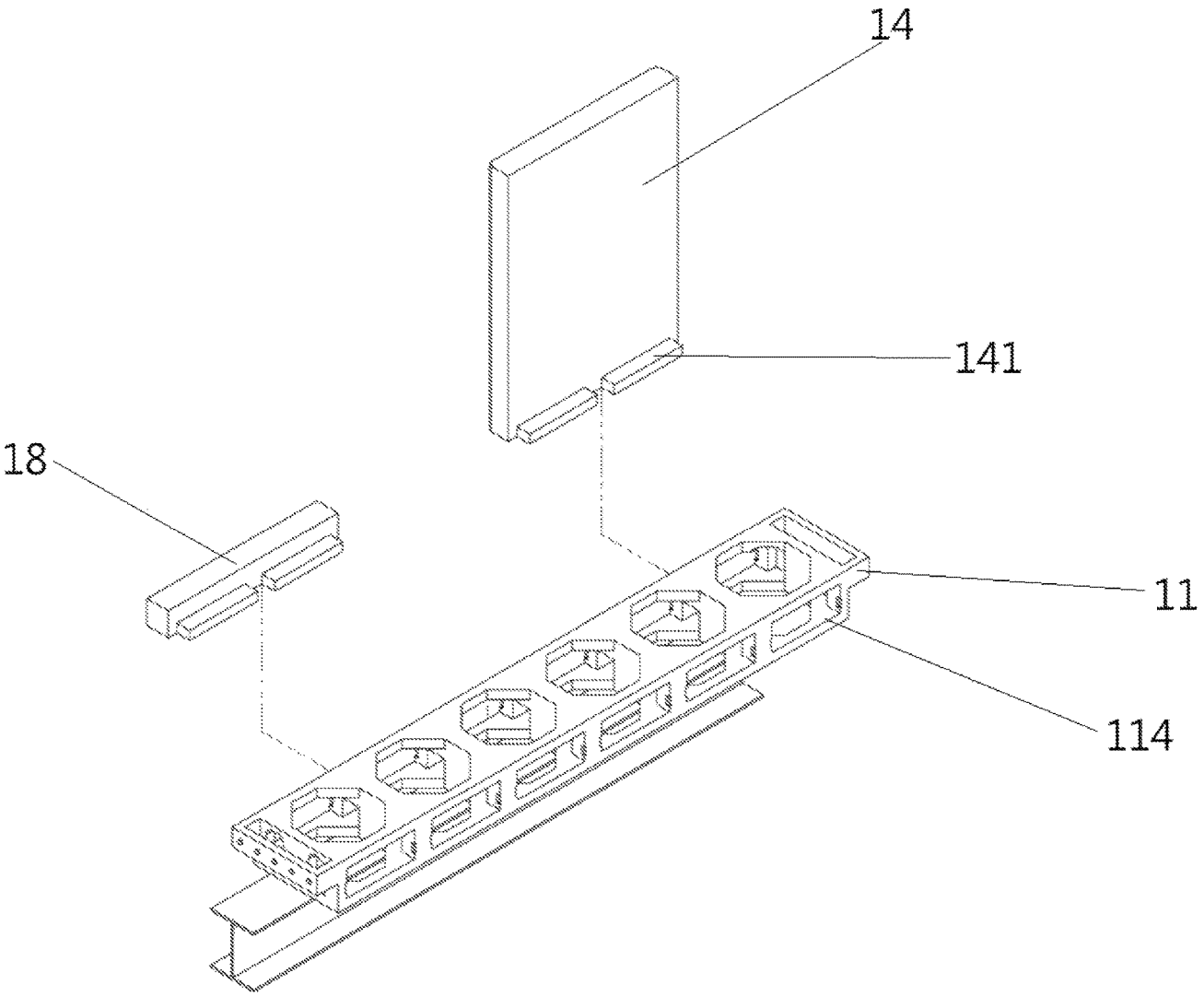
FIG. 10 illustrates another schematic view of the combination of floor slab frame and other components.

Please also see FIGS. 9 and 10, they illustrate the schematic views of the combination of floor slab frame and other components. In FIG. 9, the floor slab frame 11 is first erected on the beam and bolted in place, then the first wall panel 13 is inserted into the wall panel holes 112 and then the first projections 131 are fixed in the wall panel holes 112 through a plurality of screws or bolts 2, so as to fix the first wall panels 13 to the floor slab frames 11. Furthermore, in this embodiment, the floor module boards 15 and the ceiling module boards 16 are connected to the floor connection holes 111 and the ceiling connection holes 113 by means of a press-fit. In FIG. 10, it provides a method for fixing the second wall panels 14 to the floor slab frames 11. This structure will fill the gap between the floor slab frame 11 and the beam on the side while using bolts for fastening. Furthermore, the present invention could also comprising a door unit panel 18, which is similar to the second wall panel 14 but shorten the height. The door unit panel 18 can help to produce a space between the walls to install a door.

Figures 11, 12:
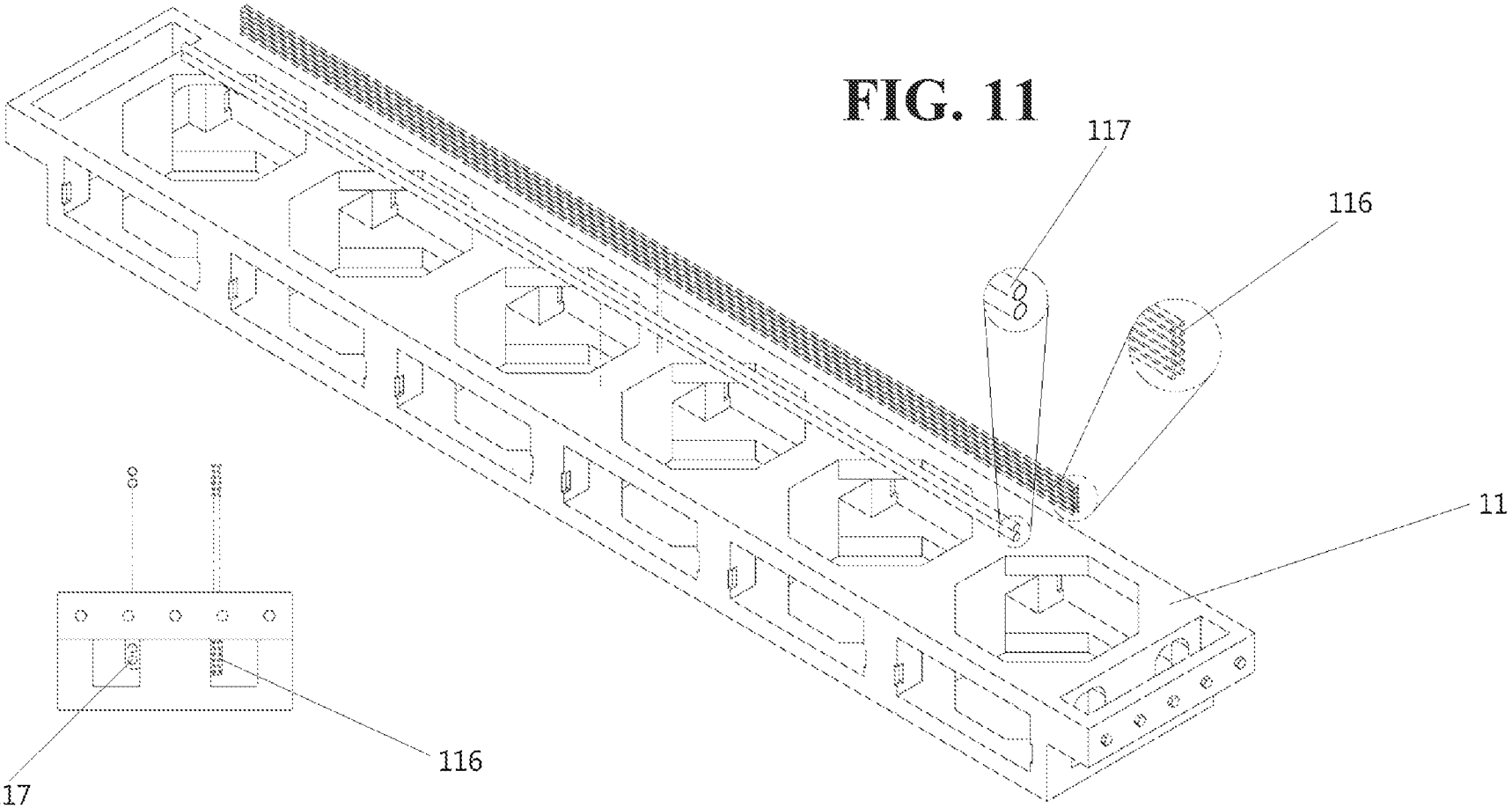
FIG. 11 illustrates the schematic view showing the electrical wiring and plumbing in the floor slab frame.
FIG. 12 illustrates the plain view showing the electrical wiring and plumbing in the floor slab frame.

Please refer to FIGS. 11 and 12, they illustrate the schematic view and the plain view showing the electrical wiring and plumbing in the floor slab frame. By prefabricating with electrical wiring 116 and plumbing 117 within the floor slab frames 11, workers can more efficiently install plumbing and wiring within the floor. In addition, some floor connection holes 111 are provided with an arc-shaped groove 119 on the bottom side edge, so as to improve the efficiency of pipeline installation.

Figure 13:
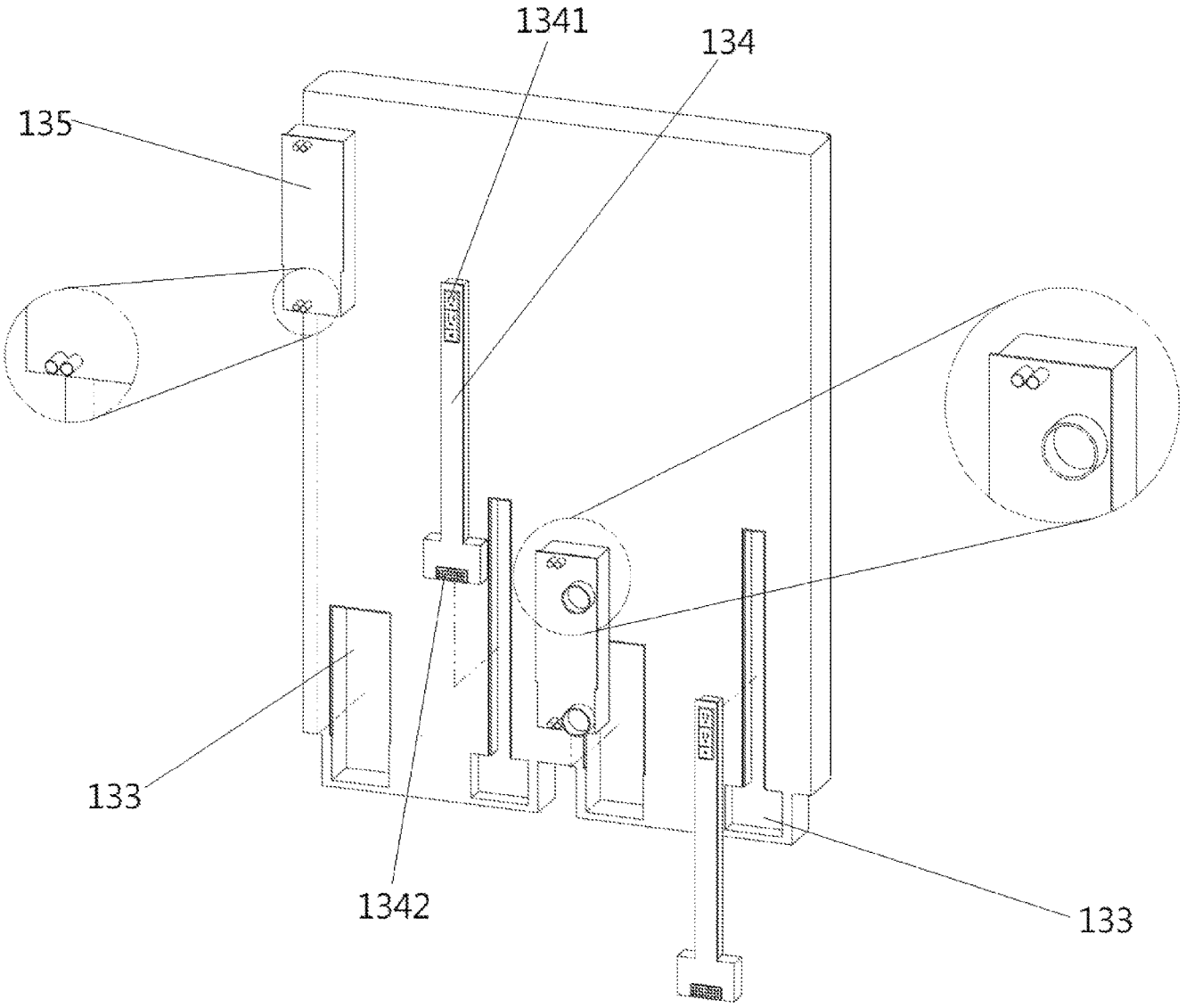
FIG. 13 illustrates the schematic view showing additional module located on the first wall panel.
Figure 14:
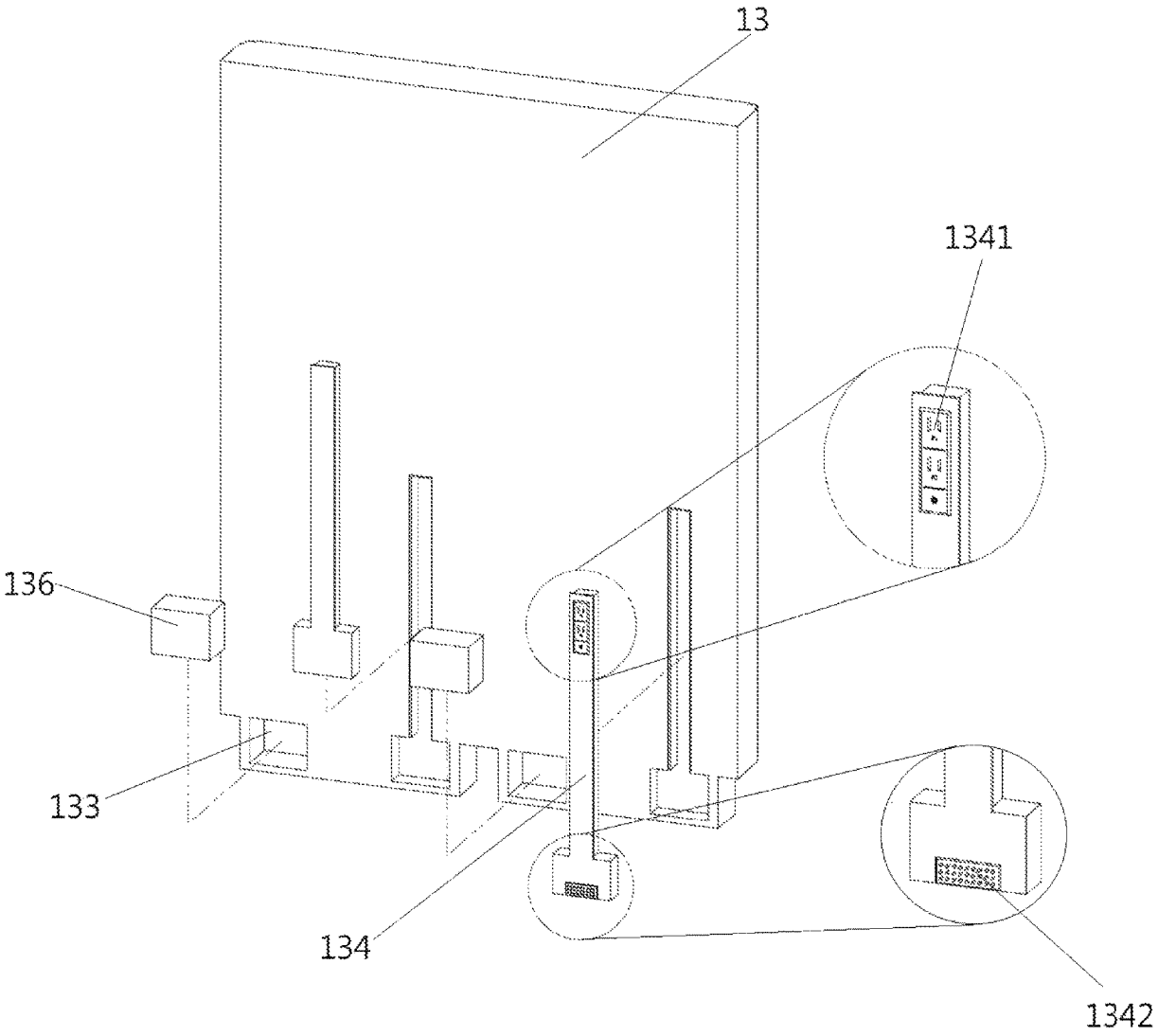
FIG. 14 illustrates another schematic view showing additional module and filling block located on the first wall panel.
Figure 15:
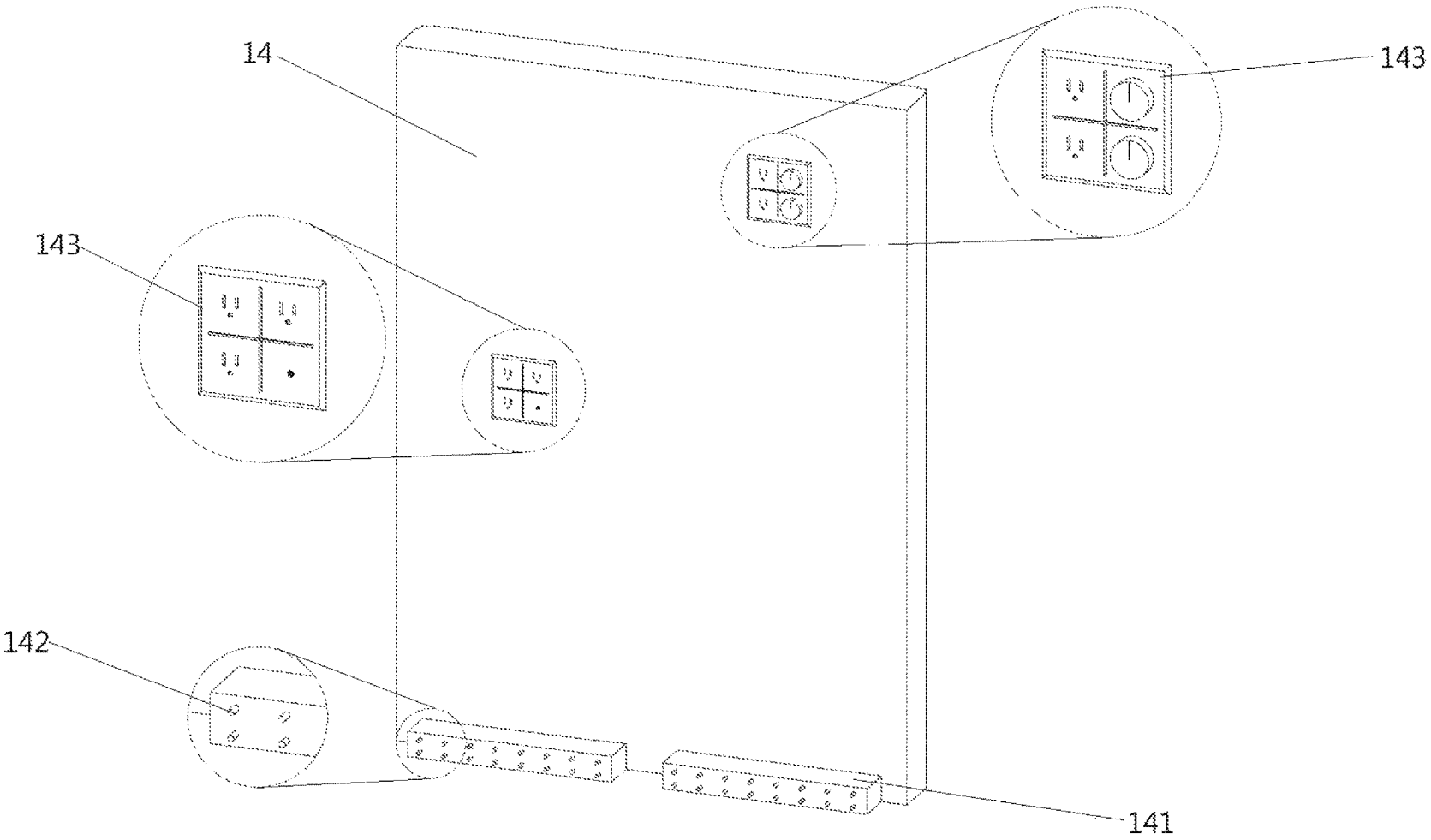
FIG. 15 illustrates the schematic view showing additional components located on the second wall panel.

Please also see FIGS. 13-15, they illustrate the schematic views showing additional module located on the first wall panel and the second wall panel. In FIGS. 13 and 14, the first wall panels 13 are provided with a plurality of grooves 133 for placing wire modules 134 and/or water pipe modules 135, and when the first wall panels 13 are connected to the floor slab frames 11, the wire modules 134 are communicated with the electrical wiring 116 in the floor slab frames 11, and the water pipe modules 135 are communicated with the plumbing 117 in the floor slab frames 11. In addition, one end of the wire module 134 is provided with at least one socket 1341 and the other end is provided with a plurality of wire contacts 1342, and the socket 1341 and the wire contacts 1342 are electrically connected through wires in the wire module 134. In other embodiments, the upper portion of the wire module 134 can also be customized with multiple power plugs as well as network plugs (FIGS. 13 and 14 show only one possibility), and the wire module 134 can also have a longer version, which is intended for the kitchen stove and sink power reserve, and can also be changed into a switch.

Furthermore, the present invention further comprising at least one filling block 136 for filling the grooves 133 when the wire modules 134 or the water pipe modules 135 are not placed in the grooves 133. In this way, under the condition that no functional modules need to be installed, the first wall panels 13 still have no empty grooves, so as to enhance the aesthetics of the present invention.

In FIG. 15, the second protrusions 141 are provided with a plurality of wire connectors 142, and surfaces of the second wall panels 14 are provided with a plurality of electrical components 143, and the electrical components 143 are electrically connected to the wire connectors 142. Of course, the second wall panels 14 are also available in a version without any prefabricated wires. Therefore, it is not limited to this embodiment.

Figure 16B:
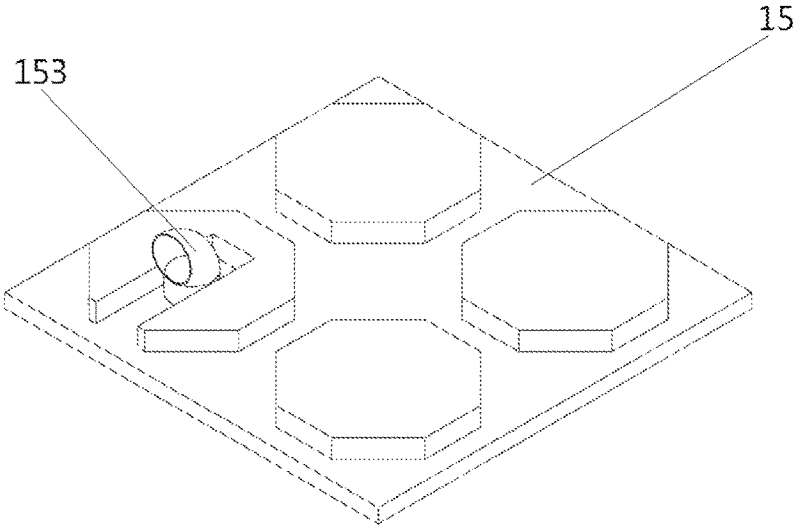
FIGS. 16A-16B illustrate the schematic view of a special floor module board in some embodiment.
Figure 16A:
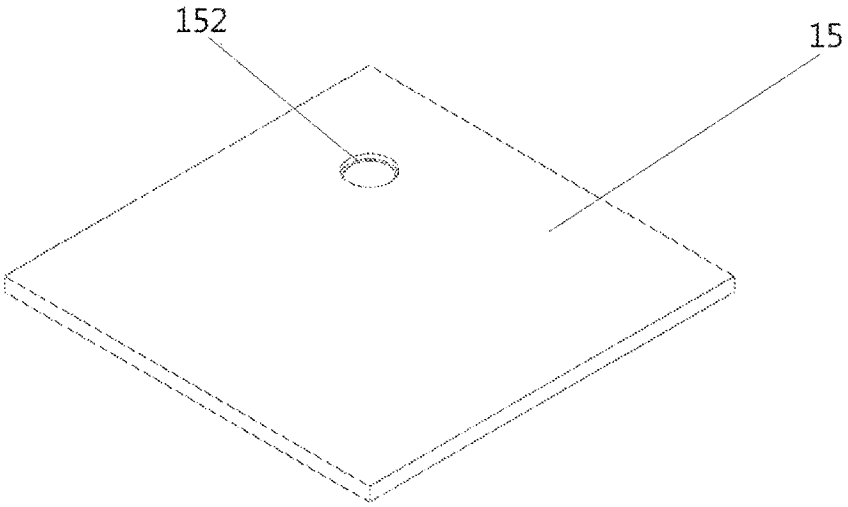

Please refer to FIGS. 16A & 16B, they illustrate the schematic view of a special floor module board in other embodiments. In those drawings, a hole 152 is provided on a surface of at least one of the floor module boards 15, and a connecting pipe 153 is provided in one of the floor projections 151 corresponding to the hole 152. Through the above structure, the floor module boards 15 can be reserved for the toilet to increase the practicability of the present invention.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A modular building structure, comprising:

a plurality of floor slab frames, at least one side of the floor slab frames is connected and fixed with beams, and a plurality of floor connection holes and a plurality of wall panel holes are arranged on a top surface of the floor slab frames, wherein the wall panel holes are respectively provided at both ends of the top surface of the floor slab frames, and bottom surfaces of the floor slab frames are provided with a plurality of ceiling connection holes; both sides of the floor slab frames are provided with a plurality of side holes, and edges of the side holes are provided with a plurality of joint holes for inserting into the joint holes of two adjacent floor slab frames through a plurality of clips, so as to connect and fix the floor slab frames together;

a plurality of first wall panels, the bottom of which is provided with a plurality of first protrusions for being inserted into the wall panel holes and fixed on the floor slab frames;

a plurality of second wall panels, which are provided with a plurality of second protrusions on a side surface adjacent to the bottom for being inserted into the side holes and fixed on the floor slab frames;

a plurality of floor module boards, one side of which is provided with a plurality of floor projections for being inserted into the floor connection holes and then fixed on the floor slab frames; and a plurality of ceiling module boards, one side of which is provided with a plurality of ceiling projections for being inserted into the ceiling connection holes and then fixed on the floor slab frames.

2. The modular building structure of claim 1, wherein the clips are U-shaped, and both ends are provided with a barbed structure to improve the connectivity with the joint holes.

3. The modular building structure of claim 2, wherein two sides of the first wall panels and the second wall panels are respectively provided with a connecting groove for a fixing member to connect the first wall panels adjacent to each other and the second wall panels adjacent to each other or connect the first wall panels and the second wall panels with adjacent columns.

4. The modular building structure of claim 3, wherein the floor module boards and the ceiling module boards are connected to the floor connection holes and the ceiling connection holes by means of a press-fit.

5. The modular building structure of claim 4, wherein after the first wall panels are connected with the floor slab frames, the first protrusions are fixed in the wall panel holes through a plurality of screws, so as to fix the first wall panels to the floor slab frames.

6. The modular building structure of claim 5, wherein the floor slab frames are prefabricated with electrical wiring and plumbing.

7. The modular building structure of claim 6, wherein the first wall panels are provided with a plurality of grooves for placing wire modules and/or water pipe modules, and when the first wall panels are connected to the floor slab frames, the wire modules are communicated with the electrical wiring in the floor slab frames, and the water pipe modules are communicated with the plumbing in the floor slab frames.

8. The modular building structure of claim 7, further comprising at least one filling block for filling the grooves when the wire modules or the water pipe modules are not placed in the grooves.

9. The modular building structure of claim 8, wherein one end of the wire module is provided with at least one socket and the other end is provided with a plurality of wire contacts, and the socket and the wire contacts are electrically connected through wires in the wire module.

10. The modular building structure of claim 9, wherein the second protrusions are provided with a plurality of wire connectors, and surfaces of the second wall panels are provided with a plurality of electrical components, and the electrical components are electrically connected to the wire connectors.

11. The modular building structure of claim 10, wherein the floor projections, ceiling projections, floor connection holes, and ceiling connection holes are octagon.

12. The modular building structure of claim 11, wherein a thickness of the ceiling module board is less than a thickness of the floor module board.

13. The modular building structure of claim 12, wherein a hole is provided on a surface of at least one of the floor module boards, and a connecting pipe is provided in one of the floor projections corresponding to the hole.

* * * * *